US010513804B2

(12) United States Patent
Pohn et al.

(10) Patent No.: US 10,513,804 B2
(45) Date of Patent: Dec. 24, 2019

(54) SPINNING MACHINE WITH A MULTIPLE NUMBER OF WORK STATIONS AND A SUCTION DEVICE

(71) Applicant: Rieter Ingolstadt GmbH, Ingolstadt (DE)

(72) Inventors: Romeo Pohn, Geisenfeld/Rottenegg (DE); Adalbert Stephan, Beilngries/Paulushofen (DE)

(73) Assignee: Rieter Ingolstadt GmbH, Ingolstadt (DE)

( * ) Notice: Subject to any disclaimer, the term of this patent is extended or adjusted under 35 U.S.C. 154(b) by 268 days.

(21) Appl. No.: 15/609,367

(22) Filed: May 31, 2017

(65) Prior Publication Data

US 2017/0350042 A1 Dec. 7, 2017

(30) Foreign Application Priority Data

Jun. 1, 2016 (DE) ..... 10 2016 110 147

(51) Int. Cl.
*D01H 1/11* (2006.01)
*D01H 1/20* (2006.01)
(Continued)

(52) U.S. Cl.
CPC ..... *D01H 1/115* (2013.01); *D01H 1/11* (2013.01); *D01H 1/20* (2013.01); *D01H 4/02* (2013.01);
(Continued)

(58) Field of Classification Search
CPC . D01H 1/115; D01H 1/10; D01H 1/20; D01H 1/00; D01H 4/00; D01H 4/02;
(Continued)

(56) References Cited

U.S. PATENT DOCUMENTS 3,780,513 A 12/1973 Watanabe et al.
3,926,665 A * 12/1975 Harrap ..... D01H 4/36 134/18
(Continued)

FOREIGN PATENT DOCUMENTS

DE 21 16 953 A1 12/1971
DE 38 10 588 A1 10/1989
(Continued)

OTHER PUBLICATIONS

German Patent Office Search Reoport, dated Jan. 23, 2017.
EPO Search Report, dated Nov. 15, 2017.

*Primary Examiner* — Ismael Izaguirre
(74) *Attorney, Agent, or Firm* — Dority & Manning, P.A.

(57) ABSTRACT

A spinning machine includes a plurality of work stations arranged side by side between two front-side ends along at least one longitudinal side of the spinning machine. Each work station has a draw-off device, and an individual drive for the draw-off device. Each work station further includes additional driven work elements for production and winding of a yarn, the additional work elements including at least a feed device, a spinning chamber, and a winding device. A suction device generates negative pressure at the work stations and includes at least one negative pressure source and at least two negative pressure channels. Each of the negative pressure channels extends in a longitudinal direction of the spinning machine only over one part of the work stations.

22 Claims, 6 Drawing Sheets

(51) Int. Cl.

| | |
|---|---|
| ***D01H 4/02*** | (2006.01) |
| ***D01H 4/24*** | (2006.01) |
| ***D01H 7/00*** | (2006.01) |
| ***D01H 11/00*** | (2006.01) |
| ***D01H 1/115*** | (2006.01) |

(52) U.S. Cl.
CPC ..... *D01H 4/24* (2013.01); *D01H 7/00* (2013.01); *D01H 11/00* (2013.01)

(58) Field of Classification Search
CPC .. D01H 4/24; D01H 4/12; D01H 4/42; D01H 7/00; D01H 7/608; D01H 11/00; D01H 11/005; D01H 11/006; D01H 1/11
See application file for complete search history.

(56) References Cited

U.S. PATENT DOCUMENTS

| | | | | | |
|---|---|---|---|---|---|
| 4,306,337 | A * | 12/1981 | Sutter | B65H 51/10 | 19/263 |
| 4,773,208 | A * | 9/1988 | Wolf | D01H 11/00 | 57/304 |
| 4,947,509 | A | 8/1990 | Dinkelmann | | |
| 5,484,116 | A | 1/1996 | Horak et al. | | |
| 5,540,043 | A | 7/1996 | Raasch | | |
| 2003/0038206 | A1 | 2/2003 | Grecksch et al. | | |
| 2017/0029234 | A1 * | 2/2017 | Maleck | B65H 54/28 | |

FOREIGN PATENT DOCUMENTS

| | | | |
|---|---|---|---|
| DE | 42 31 958 | A1 | 3/1994 |
| DE | 196 12 707 | A1 | 10/1997 |
| DE | 10017209 | A1 * | 10/2001 |
| DE | 101 39 075 | A1 | 2/2003 |
| DE | 101 45 443 | A1 | 4/2003 |
| DE | 10 2004 016 796 | A1 | 10/2005 |
| DE | 10 2006 029 056 | A1 | 12/2007 |
| DE | 10 2014 119 380 | A1 | 6/2016 |
| EP | 0 634 506 | A1 | 1/1995 |
| JP | S57 126468 | U | 8/1982 |

* cited by examiner

SPINNING MACHINE WITH A MULTIPLE NUMBER OF WORK STATIONS AND A SUCTION DEVICE

FIELD OF THE INVENTION

The present invention relates to a spinning machine with a multiple number of work stations arranged side by side in the longitudinal direction of the spinning machine on at least one longitudinal side between two front-side ends of the spinning machine. Each work station features a multiple number of work elements for the production and winding of a yarn, whereas the work elements comprise at least one feed device, one spinning chamber, one draw-off device, and one winding device, with drives for driving the work elements, and with a suction device for generating negative pressure at the work stations.

BACKGROUND

In the state of the art for spinning machines, it has long been customary to drive all of the work elements of the work stations centrally, in order to be able to operate the machines cost-effectively. In each case, the drive of the identical work elements is effected by a central drive arranged on one end of the spinning machine, which drives the work elements of all work stations by means of a shaft over the length of the machine or a tangential belt. Furthermore, the spinning machines have a central device for generating negative pressure, which is directed to the individual work stations by means of a suction channel over the length of the machine. The negative pressure is required at the spinning units to maintain the spinning process or to remove loose fibers, dust and fiber fly from components of the spinning unit. Negative pressure may also be required to suck away and dispose of separated thread pieces or to eliminate a thread breakage. However, with today's spinning machines, which are equipped with increasingly more spinning units, this machine concept is reaching its limits.

DE 101 45 443 A1 has already proposed the use of a multiple number of fans for the purpose of improving the supply of negative pressure at a condensing spinning machine, which has a particularly high requirement for negative pressure compared to rotor and air spinning machines. These supply a multiple number of negative pressure channels, which can be arranged parallel to each other or one behind the other in the longitudinal direction of the spinning machine.

DE 10 2006 029 056 A1 describes a rotor spinning machine with an intermediate frame arranged between the work stations. Herein, at least the central drive for the thread traversing devices and the device for producing the spinning negative pressure are to be arranged in the intermediate frame. This reduces both the required length of the thread guide rods and of the negative pressure channels for distributing the spinning pressure to the work stations, since they have to extend only from the intermediate frame to one of the two machine ends. Thereby, problems of the central drive of the thread guide rods caused by elongation and torsion, which increase with the machine length, can be reduced, and the supply of negative pressure can be improved.

However, in addition to the improvement of the supply of negative pressure and the avoidance of problems caused by elongation and torsion, there is also the need to be able to operate long spinning machines in an energy-efficient manner.

SUMMARY OF THE INVENTION

Therefore, a task of the present invention is to propose a spinning machine that permits the arrangement of a particularly high number of work stations on the spinning machine and at the same time enable a cost-effective operation of the machine. Additional objects and advantages of the invention will be set forth in part in the following description, or may be obvious from the description, or may be learned through practice of the invention.

A spinning machine features a multiple number of work stations arranged side by side in the longitudinal direction of the spinning machine between two front-side ends on at least one longitudinal side of the spinning machine. Each of the work stations features a multiple number of work elements for the production and winding of a yarn, including at least one feed device, one spinning chamber, one draw-off device, and one winding device. Furthermore, the spinning machine features drives for driving the work elements and a suction device for generating negative pressure at the work stations.

The suction device includes at least one negative pressure source and at least two separate negative pressure channels, which extend in the longitudinal direction of the spinning machine only over one part of the work stations. Furthermore, each work station features an individual drive as the drive for the draw-off device. The individual drive is preferably designed as an individual electrical drive, but could also be a pneumatic drive.

Given that two or more negative pressure channels are provided, which only have to supply a part of the work stations, the pressure losses arising over the length of the negative pressure channel can be significantly reduced. It is thereby possible to use one or more negative pressure sources with a lower suction capacity.

In addition, given the fact that the draw-off devices of the work stations of the spinning machine are individually driven, they can be stopped or put into operation independent of each other. Thus, no energy has to be used for the drive of the draw-off device when the work station is stationary (thus, for example, during maintenance operations or upon disruptions). Since, with modern spinning machines with a multiple number of work stations, it is nearly constantly the case that at least one work station is stationary, a distinct energy saving can be achieved by means of the individually driven draw-off devices, despite the higher expenditure of an individual drive. In addition, an individually driven draw-off device enables a controlled stopping and starting of the individual work stations and an individual adjustment of the draft. In particular, when spinning in at an air spinning machine, the draft can be precisely adjusted by a monitored and controlled starting up of the draw-off device, such that high-quality piecings can be produced.

If only one negative pressure source is used, this is advantageously arranged in a middle area of the spinning machine, from which the at least two negative pressure channels extend to both sides. However, it is also conceivable to arrange at least two negative pressure sources in the middle area of the spinning machine, which then supply each of the spinning units between one of the ends of the spinning machine and the middle area.

According to an additional design, it is advantageous if the spinning machine features at least two separate negative pressure sources, whereas each of the negative pressure sources is connected to a separate negative pressure channel. Herein it is advantageous if at least one of the negative pressure sources is arranged on at least one of the two front-side ends of the spinning machine. In this case, at least one additional negative pressure source can be arranged either in a middle area between the two front-side ends of the spinning machine, or else at the other front-side end of the spinning machine. However, it is also possible to provide at least one negative pressure source at each of the two ends of the spinning machine, or, in particular in the case of very long machines, at least one negative pressure source at each of the two ends and at least one additional negative pressure source in a middle area of the spinning machine. In any case, through the separate negative pressure channels, the total capacity of the at least two separate negative pressure sources can be lower than it would be in the case of a single negative pressure source with a continuous negative pressure channel.

Preferably, the negative pressure sources are herein arranged in a frame that is either located at a front-side end of the spinning machine or is provided as an intermediate frame in the middle area of the spinning machine. It is thereby possible to accommodate central drives of the spinning machine and the negative pressure source in a common frame. However, it is also conceivable to arrange the negative pressure sources in a separate housing or frame.

Therefore, the spinning machine with individually driven draw-off devices and with a subdivided supply of negative pressure with at least two negative pressure sources enables a particularly energy-saving and cost-effective operation, based on the optimum arrangement and drive form of such two components, which are essential for energy consumption. In addition, through the subdivided supply of negative pressure, it is also possible to provide a greater level of negative pressure at the spinning units as a whole, such that better spinning stability and better yarn stability can be achieved. With this, accessibility to the negative pressure sources and to their filter boxes, in which contaminants and waste that are sucked away are collected, is not impaired. This also facilitates maintenance and the supply and disposal by operators or by automatic maintenance devices, which further contributes to the cost-effective operation of the machine.

It is advantageous if each of the work stations features at least one suction point, which is arranged either in the area of the spinning chamber or in the area of the feed device. For example, a rotor spinning machine features a suction point in the area of the spinning chamber. Since rotor spinning machines have a particularly high requirement for negative pressure because of the spinning negative pressure required for the spinning process, with such machines, the subdivided supply of negative pressure with a negative pressure source at each end is particularly advantageous. It is also possible to achieve an adequate level of negative pressure even on long machines with more than 500 work stations and at work stations remote from the negative pressure source. Since the work stations are evenly supplied with negative pressure, quality problems of the yarn that is produced can also be avoided.

However, it is also advantageous if the spinning machine is an air jet spinning machine. This features, for example, a suction point in the area of the spinning chamber, such that fibers not bound into the yarn are sucked away; otherwise, they would lead to the clogging of the spinning element and to impairments to the quality of the yarn that is produced. Likewise, the air jet spinning machine can feature at least one suction point in the area of the feed device, in order to transport outgoing fibers away and to avoid lap formation. Therefore, it is also particularly advantageous if, in the case of an air jet spinning machine, each of the work stations features at least one first suction point in the area of the spinning chamber and at least one additional suction point in the area of the feed device. By means of the divided suction device, energy-efficient fans with a lower capacity can also be used with such a spinning machine with an inherently higher requirement for negative pressure.

Furthermore, it is advantageous if each of the negative pressure sources features a fan and a drive for the fan. The drives of the negative pressure sources are preferably controllable by a central control device of the spinning machine. This may comprise at least two identical drives and fans. However, if a different level of negative pressure is required in the at least two negative pressure channels, for example in the case of different spinning applications, or if the negative pressure channels are of different length, different fans and drives can also be used. Herein, it is also advantageous that a separate filter box is assigned to each of the fans, such that the collected waste can be disposed of at both ends of the machine. Thus, the rapid clogging of the filters and a concomitant drop in negative pressure can also be avoided.

For an energy-saving operation of the spinning machine, it is advantageous if at least 20%, preferably at least 30%, more preferably at least 40%, of the work stations arranged side by side on at least one longitudinal side in the longitudinal direction of the spinning machine is connected on each of the at least two negative pressure channels. This ensures that the pressure losses in the negative pressure channels are kept within narrow limits, and that the individual work stations are evenly supplied with negative pressure. It is also advantageous if the two negative pressure channels are of the same length and/or if the same number of work stations are connected to the two negative pressure channels. Compared to a single, negative pressure channel over the length of the machine, the negative pressure channels can be reduced to approximately half of the previous length, by which pressure losses can be reduced in an optimum manner.

According to a structurally advantageous and space-saving design of the spinning machine, it is provided that the at least two negative pressure channels are arranged in an aligned manner one behind the other in the longitudinal direction of the spinning machine. It is thereby also possible to adopt the previous machine configuration with a single, continuous negative pressure channel, and to use only a partition or a shutter for flexible subdivision, in order to form the two separate negative pressure channels. Alternatively, however, it is also conceivable for the two negative pressure channels to run at least partially parallel to each other with respect to the longitudinal direction of the spinning machine. This makes it possible to, depending on the need, connect individual work stations to one or the other negative pressure channel, and thereby to flexibly design the supply of negative pressure.

Likewise, it is advantageous if, in the case of an air jet spinning machine, negative pressure of at least 2000 Pa is achieved in each of the negative pressure channels at one end of the respective negative pressure channel opposite to the negative pressure source. Thereby, the supply of the work stations with a largely uniform level of negative pressure can be ensured. With a rotor spinning machine, on the other hand, it is advantageous if negative pressure of 6000 Pa is still achieved at one end of the negative pressure channel opposite to the negative pressure source.

Furthermore, it is advantageous if each work station features an individual drive, in particular an individual electrical drive for the feed device. In particular for a semiautomatic rotor spinning machine, this makes it possible in a particularly advantageous manner to adjust the feed rate of the fibers to the prevailing conditions at the work station. In the case of an air spinning machine, on the other hand, at least one pair of delivery rollers driven by means of an individual drive is provided as the feed device, such that the quantity of the fiber material supplied here can also be matched precisely to the respective prevailing conditions. If the feed device is designed as a drafting device, it is advantageous if such device is formed by means of an individual drive for each spinning unit.

The aforementioned pair of delivery rollers is a component of the feed device, such that all the rollers of the feed device are driven by a common individual drive for each spinning unit. Alternatively, however, it is also conceivable to drive the feed device and the pair of delivery rollers by means of two or more individual drives for each work station. Thereby, the draft can be set individually at each work station, which facilitates the manufacturing of various products on a machine.

If, with the spinning machine, work stations are arranged between the front-side ends on both longitudinal sides, it can be advantageous if each of the two longitudinal sides is likewise supplied with negative pressure separately. Thus, two negative pressure sources are provided at each of the two ends; each of the two negative pressure sources is connected to a separate negative pressure channel, which in turn extends only over part of the work stations arranged side by side in the longitudinal direction.

According to an additional form of the invention, it is particularly advantageous for an air jet spinning machine if at least the winding devices are each driven by means of a single electric drive. The spinning machine is thereby particularly flexible and allows the production of different products and a flying lot change. In particular, if the work stations additionally have their own thread handling elements, long wait times for the maintenance or repair of thread breakages can also be avoided, which in turn increases productivity. In addition, it can also be advantageous to drive the thread laying by means of an individual drive.

According to an additional form of the invention, the additional work elements, at least the winding devices, are driven on one longitudinal side by means of central drives. Since these revolve with comparatively low rotational speeds, even with longer machines with a particularly high number of spinning units, for example, more than 500 spinning units with a rotor spinning machine or more than 120 with an air spinning machine, the losses are still in a range in which a central drive proves to be cost-effective. In the case of a semiautomatic rotor spinning machine, a particularly cost-effective operation also arises if the resolving devices are also driven by means of a central drive.

Furthermore, it is advantageous if identical centrally driven work elements of a longitudinal side each form at least two groups, whereas a separate central drive for driving one of the two groups is arranged in each of the two frames on the front-side ends. Thereby, a shortening of the drive means, which is typically over the length of the machine, of up to half of the otherwise required length can in turn be achieved. As a result, problems caused by torsion and elongation can not only be reduced; rather, the losses due to flexing work in the belt can also be reduced. With this, each of the at least two groups per longitudinal side of the spinning machine may comprise the same number of work stations or even different numbers. It is advantageous if, in turn, at least 20% of all work stations on one longitudinal side is assigned to a central drive in each case.

It is also advantageous if the spinning machine features at least two package conveyor belts arranged one behind the other in the longitudinal direction of the spinning machine. This also results in high losses, which can be reduced by the use of two shorter belts with smaller drives in place of a single belt with a large drive.

Likewise, it is advantageous if the spinning machine features an intermediate storage unit for empty sleeves, in order to shorten the delivery paths and thus also the belt running times for supplying empty sleeves.

According to an additional form of the invention, it can be advantageous if deflection rollers of central drives and/or drives and/or storage units for central supply and disposal devices are arranged in the intermediate frame.

The supply of empty sleeves can be further facilitated and the delivery times for empty sleeves can be shortened if the spinning machine features a central sleeve storage unit for empty sleeves at each of its front-side ends. Preferably, these are arranged at a distance from the two frames, in order to allow access to the frames.

Furthermore, it is advantageous if the spinning machine features, at each of its two front-side ends, a connection for the feed of energy, in particular for a power supply for the electrical components and/or for a compressed air supply.

It is likewise advantageous if the spinning machine features an exhaust air outlet of the suction device at each of its two front-side ends. A protective discharge can also be provided at the two ends of the machine.

BRIEF DESCRIPTION OF THE DRAWINGS

Additional advantages of the invention are described on the basis of the following presented embodiments. The following is shown.

DETAILED DESCRIPTION

Figure 1:
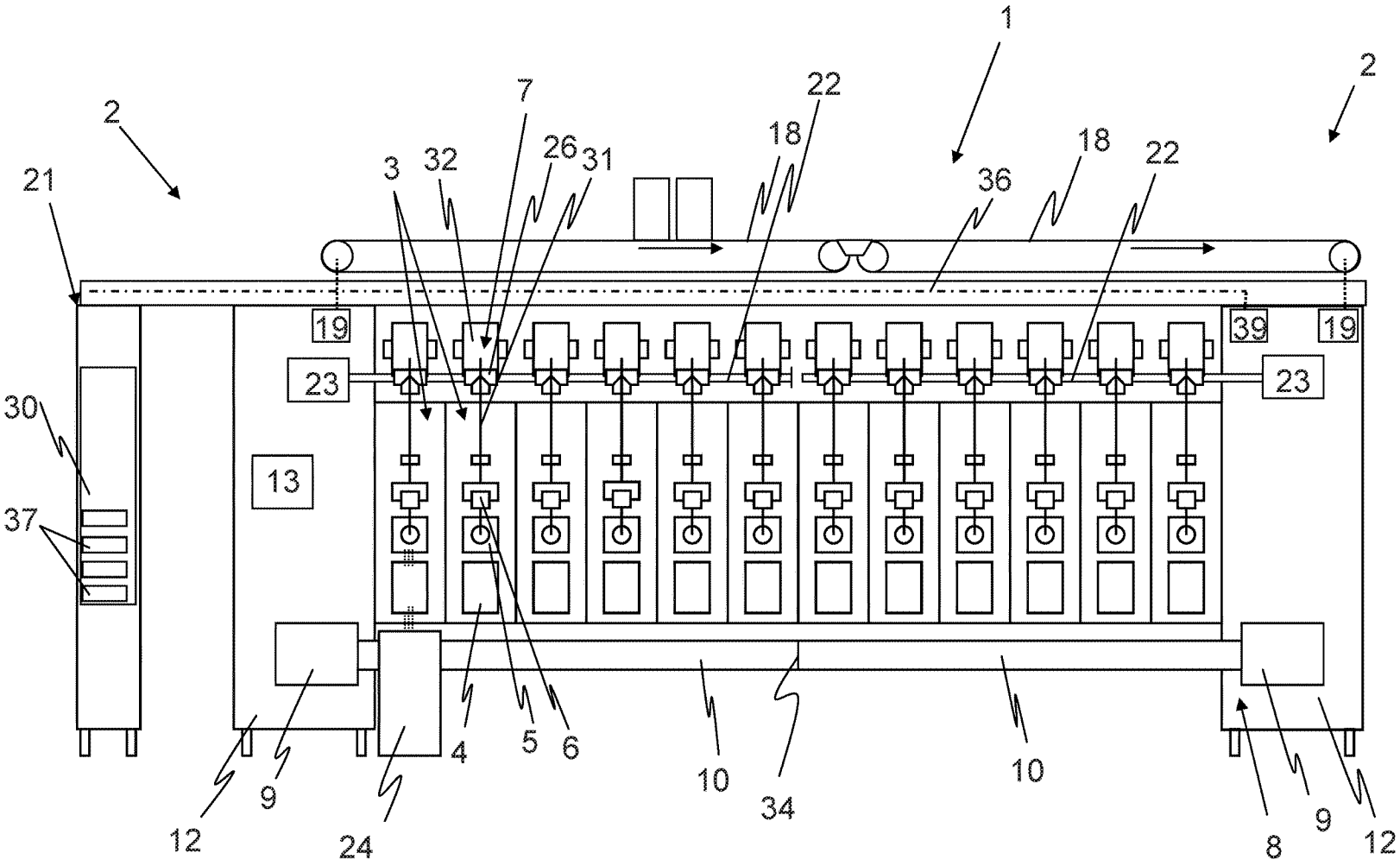
FIG. 1 is a spinning machine in a schematic top view in accordance with a first design.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic view of a spinning machine 1, which is particularly suitable for arranging a multiple number of work stations 3 side by side in the longitudinal direction of the spinning machine 1. The work stations 3 are arranged side by side between two front-side ends 2, and each features a multiple number of work elements 4, 5, 6, 7 for producing and winding a yarn 31 in a manner known per se. Each work station 3 features a feed device 4, by means of which a fiber material is fed from a storage hopper 24 into a spinning chamber 5, in which it is spun into the yarn 31. From the spinning chamber 5, the yarn 31 is drawn off by means of a draw-off device 6 and ultimately wound onto a coil 32 by means of a winding device 7. Furthermore, the spinning machine 1 features a suction device 8 that serves the purpose of supplying the work stations 3 with negative pressure and is also provided for the removal of contaminants and waste from the work stations 3, which arise during the spinning in and upon the maintenance of the work stations 3.

In order to meet market demands for an increase in the productivity of spinning machines 1, it is necessary to increase the number of work stations 3 per spinning machine 1. This calls into question conventional machine concepts, in which the work elements 4, 5, 6, 7 of a work station 3 are each driven centrally from a front-side frame 12. In addition, in view of the ever increasing energy costs, there is also the need to keep the operating costs for such spinning machines 1 low, even when the machine is extended.

Therefore, the spinning machine 1 shown here features a suction device 8 with at least two separate negative pressure sources 9 and at least two separate negative pressure channels 10 for the supply of negative pressure. Herein, each of the negative pressure sources 9 is connected to one of the separate negative pressure channels 10, which extend in the longitudinal direction of the spinning machine 1 only over a part of the work stations 3. In accordance with FIG. 1, the negative pressure sources 9 are arranged on the front-side ends 2 of the spinning machine 1; in the present case, each of them is arranged on the front-side frames 12. In the present case, the negative pressure channels 10 are arranged in an aligned manner one behind the other in the longitudinal direction of the spinning machine 1, such that only small installation space is required. Herein, a division 34 between the two negative pressure channels 10 can be designed to be fixed or flexible, for example, in which a continuous channel is subdivided into two negative pressure channels by means of a displaceable shutter.

In each case, each work station 3 is connected to at least one of the at least two negative pressure channels 10, whereas, on the other hand, only part of the work stations 3 is connected to each of the negative pressure channels 10. Furthermore, a central control device 13 is arranged in one of the frames 12, by means of which the drives of the negative pressure sources 9, all of the central drives 23 and the belt drives 19, 39 can be controlled, as will be explained below.

Figure 2:
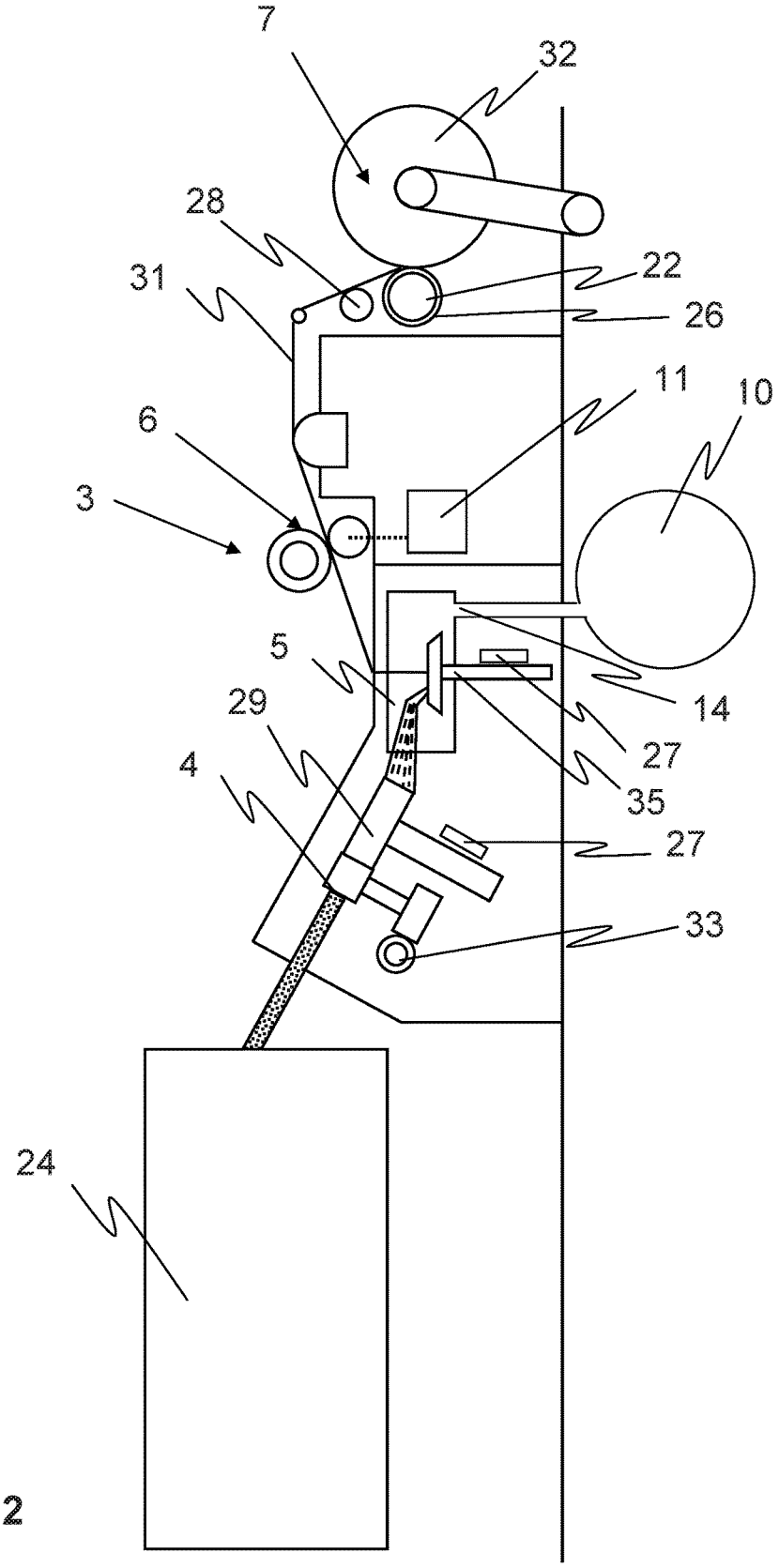
FIG. 2 is a work station of a rotor spinning machine in a schematic sectional view.

Herein, the spinning machine 1 of FIG. 1 can be formed, for example, as a semi-automatic spinning machine 1. A work station 3 of such a rotor spinning machine designed as a semi-automatic spinning machine 1 is shown in FIG. 2. In contrast to a fully automatic spinning machine 1, in which maintenance activities (such as spinning in) are carried out by means of movable maintenance devices or maintenance devices of their own spinning units, the semiautomatic spinning machine must be operated at least partially manually. In addition to the work elements 4, 5, 6, 7 of the work station 3 described in conjunction with FIG. 1, in the present case, an opening roller 29, a thread guide rod 28, a winding roller 26 arranged on the winding roller shaft 22, and a spinning rotor 35 arranged in the spinning chamber 5 are also shown. In the present case, the feed device 4 is formed as a feed roller. In addition, a suction point 14 arranged in the area of the spinning chamber 5 can be seen.

By means of the described distributed supply of negative pressure with at least two shorter negative pressure channels 10, it is possible to supply the work stations 3 of the spinning machine with negative pressure in a highly uniform manner, and to provide a higher overall level of negative pressure as a whole. Despite the more complex suction device 8 in and of itself, a cost-effective operation of the machine 1 is possible, since the total losses of negative pressure relative to the spinning machine 1 can be reduced compared to a single, central negative pressure source 9, and quality problems of the yarn that is produced can also be reduced.

For the energy-saving operation of the spinning machine 1, the draw-off devices 6 of each work station 3 are also driven by means of an individual drive 11. Thus, the draw-off devices 6 can also be stopped in the event of an interruption in production. In addition, the individually driven draw-off devices 6 enable a controlled shutting down and starting up of the work station 3, which facilitates the spinning in process and avoids thread breakages. However, the additional work elements of the work station 3 are driven centrally or at least in a group-by-group manner by means of central drives 23 (see FIG. 1), which are not visible here. Thus, the feed device 4 can be driven by means of a shaft 33, while the opening roller 29 and the spinning rotor 35 of the spinning chamber 5 are driven by means of a tangential belt 27. The winding roller 26 of the winding device 7 is driven by means of the centrally driven winding roller shaft 22, and a thread guide (not shown here) is driven by means of the likewise centrally driven thread guide rod 28.

It has been shown that, by means of the combination of an individual drive 11 for the draw-off device 6 and central drives 23 for the additional work elements of the work stations 3, an operation of the spinning machine 1 that is particularly energy-saving and cost-effective at the same time is possible. However, in deviation from the view that is shown, it is also possible to drive additional work elements 4, 7 or 26, 28, 29, as the case may be, of a work station 3 by means of individual drives 11. Here, in the case of a semiautomatic spinning machine 1, it is particularly advantageous to drive, in addition to the draw-off device 6, the feed device 4 by means of an individual drive 11, in order to be able to control the fiber quantity that is fed. In this case, the additional work elements 7 with 26, 28, 29 are preferably once again centrally driven.

Figure 3:
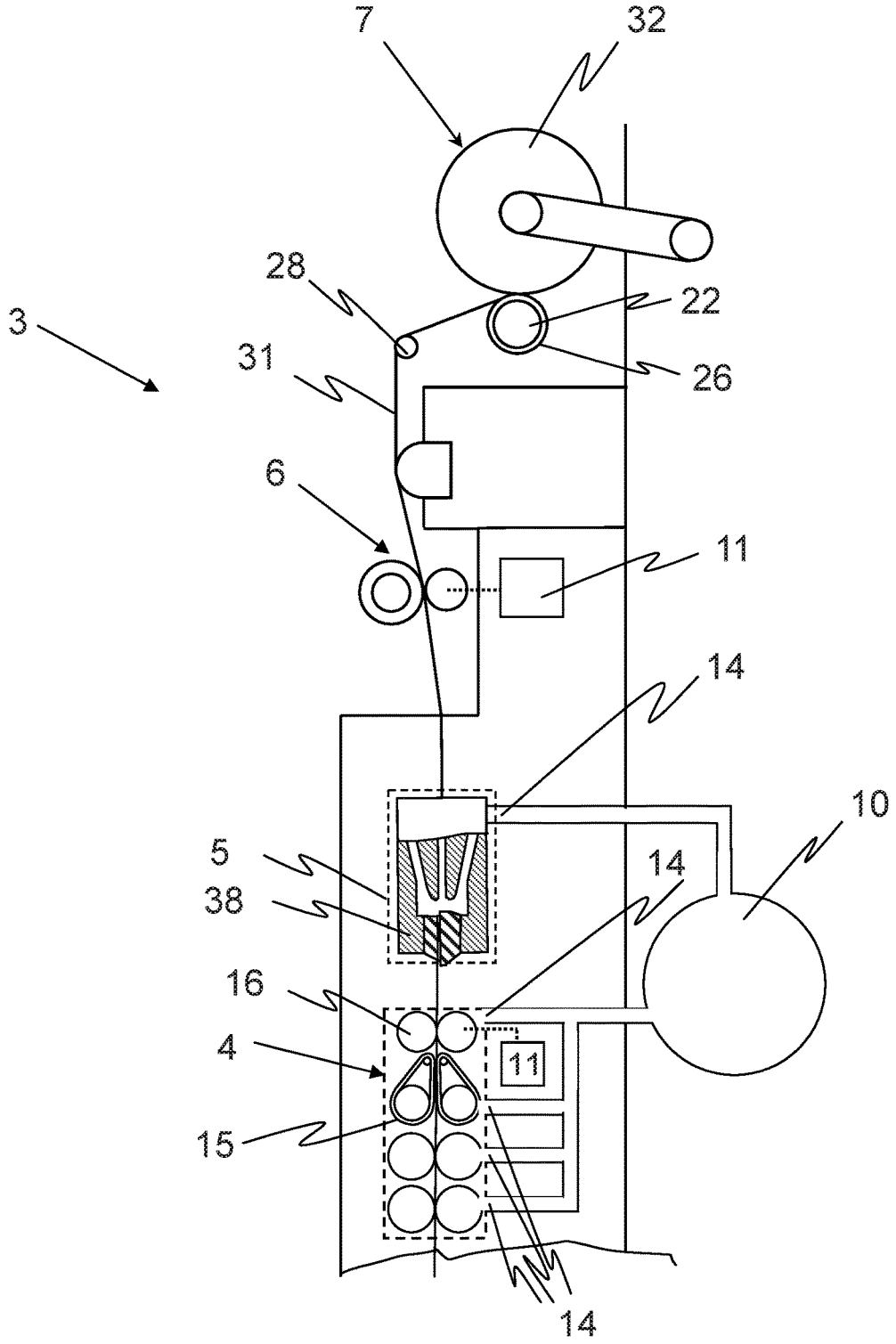
FIG. 3 is a work station of an air jet spinning machine in a schematic sectional view.

Alternatively, however, the spinning machine 1 of FIG. 1 can also be designed as an air spinning machine. FIG. 3 shows a work station 3 of such a spinning machine 1 designed as an air spinning machine. In contrast to a rotor spinning machine, with an air spinning machine, the spinning chamber 5 is provided with a spinning nozzle 38. In the present case, the feed device 4 includes a drafting device 15 and a pair of delivery rollers 16, by means of which a band-shaped fiber material is initially drafted and ultimately fed via the delivery rollers 16 to the spinning chamber 5. The additional work elements 6, 7 with 26, 28 of the work station 3 correspond to those of FIG. 2, such that they are not discussed in detail. The suction device 8 corresponds to that described for FIG. 1, which provides a distributed supply of negative pressure with at least two negative pressure sources 9 and at least two negative pressure channels 10, such that the work stations 3 can also be uniformly supplied with a high degree of negative pressure, even at the air spinning machine.

As can be seen in FIG. 3, the work station 3 features at least two suction points 14, one of which is arranged once again in the area of the spinning chamber 5 and at least an additional one of which is arranged in the area of the feed device 4. In the present case, in the area of the feed device 4, four suction points 14 are provided, each of which is assigned to the lower rollers of the feed device 4. Due to the distributed supply of negative pressure, the work stations 3 can also be supplied with a sufficient negative pressure, even with very long machines 1, at any position within the machine 1.

In this case as well, the draw-off device 6 is once again driven with an individual drive 11 which, as described above with reference to FIG. 2, enables an energy-saving operation of the spinning machine 1 in combination with the distributed supply of negative pressure. In order to be able to adjust the draft and the fiber material feed individually at each work station, in the present case, the feed device, in addition to the draw-off device, is driven by means of an individual drive 11. Herein, as shown in the present case, a single individual drive 11 can be provided for the entire feed device 4, or the pairs of rollers of the feed device 4 can each be driven individually by means of a separate individual drive 11. The additional work elements 26, 28 of the work stations 3 are, in the present case, once again driven centrally, at least in a group-by-group manner. Such a combination of central drives 11 and individual drives 23 with the distributed supply of negative pressure has proved to be an advantageous compromise for energy-saving operation with high yarn quality at the same time. However, it is also conceivable to drive the winding device 7 and the thread laying by means of additional individual drives 11. In this case, it is advantageous here that, by means of the individually drivable draw-off device 6, the draft in the yarn 31 can be adjusted individually and for each production step, which, among other things, enables the production of particularly high-quality piecings.

In any case, it is advantageous if the centrally driven work elements 4, 5, 7 with 26, 28, 29 are driven centrally in a group-by-group manner. As can be seen in FIG. 1, the work stations 3 of a longitudinal side of the spinning machine 1 are divided into two groups, whereas each of the two groups is assigned to its own central drives 23. In the present case, only central drives 23 for the winding 7 or the winding roller shaft 22 are shown as examples. However, depending on the design of the spinning machine 1, additional central drives 23, for example for the thread laying or thread guide rods 28 or, in the case of a rotor spinning machine, for opening rollers 29 and spinning rotors 35, can also be provided. In this case, the central drives 23 are accommodated in the frames 12 arranged on the front-side ends 2. Furthermore, central drives 19 and 39 can also be arranged there for package conveyor belts 18 for the disposal of the finished coils and one or more sleeve conveyor belts 36 for supplying the work stations with empty sleeves 37.

Since considerable friction losses can arise between the package conveyor belt 18 and guide plates of the spinning machine 1, powerful drives are necessary for long spinning machines 1. Therefore, in the embodiment of FIG. 1, two package conveyor belts 18 are provided one behind the other in the longitudinal direction; each of these is provided with its own drive 19. Due to the fact that the package conveyor belts 18 extend only over a part of the work stations 3 arranged side by side in the longitudinal direction, the two drives 19 can be designed to be substantially smaller, and are therefore designed to be cost-effective.

In the present case, the supply of the work stations 3 with empty sleeves 37 takes place by means of a central supply device 21. This includes a central storage unit 30 for empty sleeves 37 and a sleeve conveyor belt 36 over the length of the machine in the present case, which is illustrated only by a dotted line. In the present case, the drive 39 of the sleeve conveyor belt is arranged in the frames 12 shown on the right.

In the present case, only one longitudinal side of a spinning machine 1 is shown. It is understood that the spinning machine 1 may feature a multiple number of work stations 3 on its two longitudinal sides. In this case, the described arrangement of the drives 23, 19 and 39 and the sleeve conveyor belt 36 are also provided on the opposite longitudinal side of the rotor motor 1 in an analogous manner. If the work stations 3 of each longitudinal side are subdivided into two groups, four central drives 19, 23, two of which are arranged on each of the two front-side ends, are respectively provided for identical work elements. With this, it may also be advantageous to provide the two longitudinal sides of the rotor spinning machine 1 with negative pressure, in each case separately from each other. In this case, two separate negative pressure channels 10, which are each assigned to one of the two longitudinal sides of the spinning machine 1, would be arranged on each of the two front-side ends 2.

Figure 4:
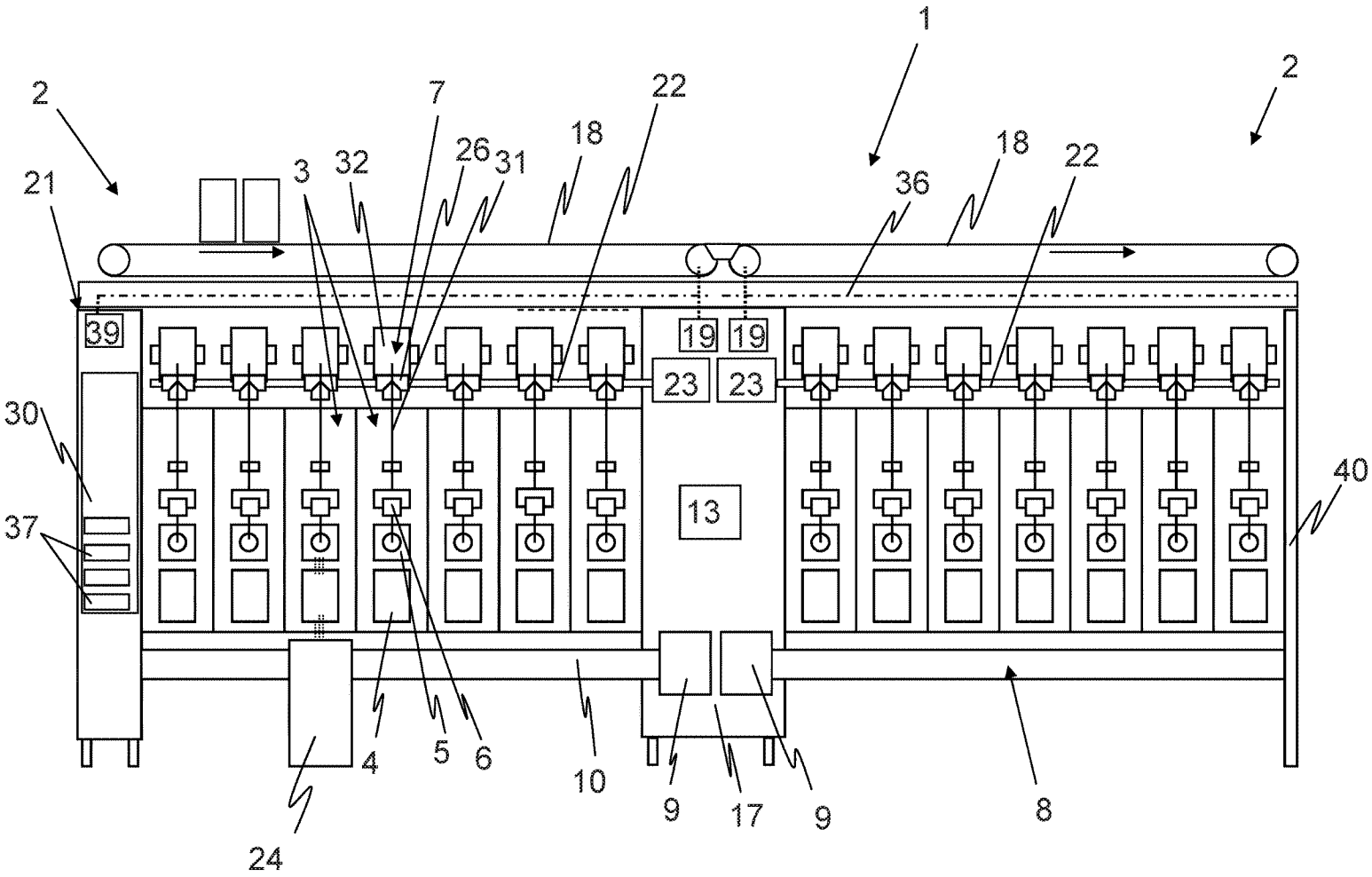
FIG. 4 is a spinning machine in a schematic top view in accordance with a second design.

FIG. 4 shows an additional design of a spinning machine 1 which, like that of FIG. 1, can be designed as a rotor spinning machine with work stations 3 in accordance with FIG. 2 or as an air spinning machine with work stations 3 in accordance with FIG. 3. The individual components and assemblies of the spinning machine 1 of FIG. 3 essentially correspond to those of FIG. 1, such that only the differences with FIG. 1 will be discussed in the following.

In contrast to FIG. 1, the spinning machine 1 of FIG. 3 does not feature any frames 12 on the front-side ends 2 of the spinning machine 1; rather, it solely features an intermediate frame 17 arranged between the ends 2. The suction device 8 of the spinning machine 1 also features at least two separate negative pressure sources 9 and at least two separate negative pressure channels 10. However, the negative pressure sources 9 are not arranged on the front-side ends 2 of the spinning machine 1, but in a middle area, in the present case in an intermediate frame 17, between the two ends 2. The negative pressure channels 10 are also arranged in an aligned manner one behind the other in the longitudinal direction of the spinning machine 1, whereas each work station 3 is connected to at least one of the negative pressure channels 10. In this design, the work stations 3 of the spinning machine can also be uniformly supplied with negative pressure, whereas the losses of negative pressure can be reduced.

With this design as well, an energy-saving combination of an individual drive 11 for the draw-off devices 6, by means of which the draft in the yarn 31 can be adjusted comparatively freely, and central drives 23, in particular central drives 23 arranged in a group-by-group manner, is provided for the additional work elements 4, 5, 7 and, if applicable, 29 of the work stations 3. In this case, the central drives 23, the belt drives 19, 39 and the central control device 13 can advantageously be accommodated in the intermediate frame 17, such that a spinning machine 1 of this type is also particularly space-saving. However, with this design, an energy-saving division of the central and belt drives 23, 19, 29 with respect to the longitudinal direction of the spinning machine 1 is also possible.

However, as an alternative to the view that is shown, as described above with reference to FIGS. 1-3, additional work elements 4, 5, 7, 28 and, if applicable, 29 can also be driven by means of individual drives 11.

With this design, it is also advantageous that, due to the lack of frames 12, various accommodating options exist for a supply device 21 for empty sleeves 37. In the present case, for example, the supply device 21 is arranged on one end 2 of the spinning machine 1, while only one support 40 is provided at the other end 2. Here, it is also conceivable to arrange individual central or belt drives 23, 19, 39 in the supply device 21, as shown here, for example, for the drive 39 of the sleeve conveyor belt 36.

Figure 5:
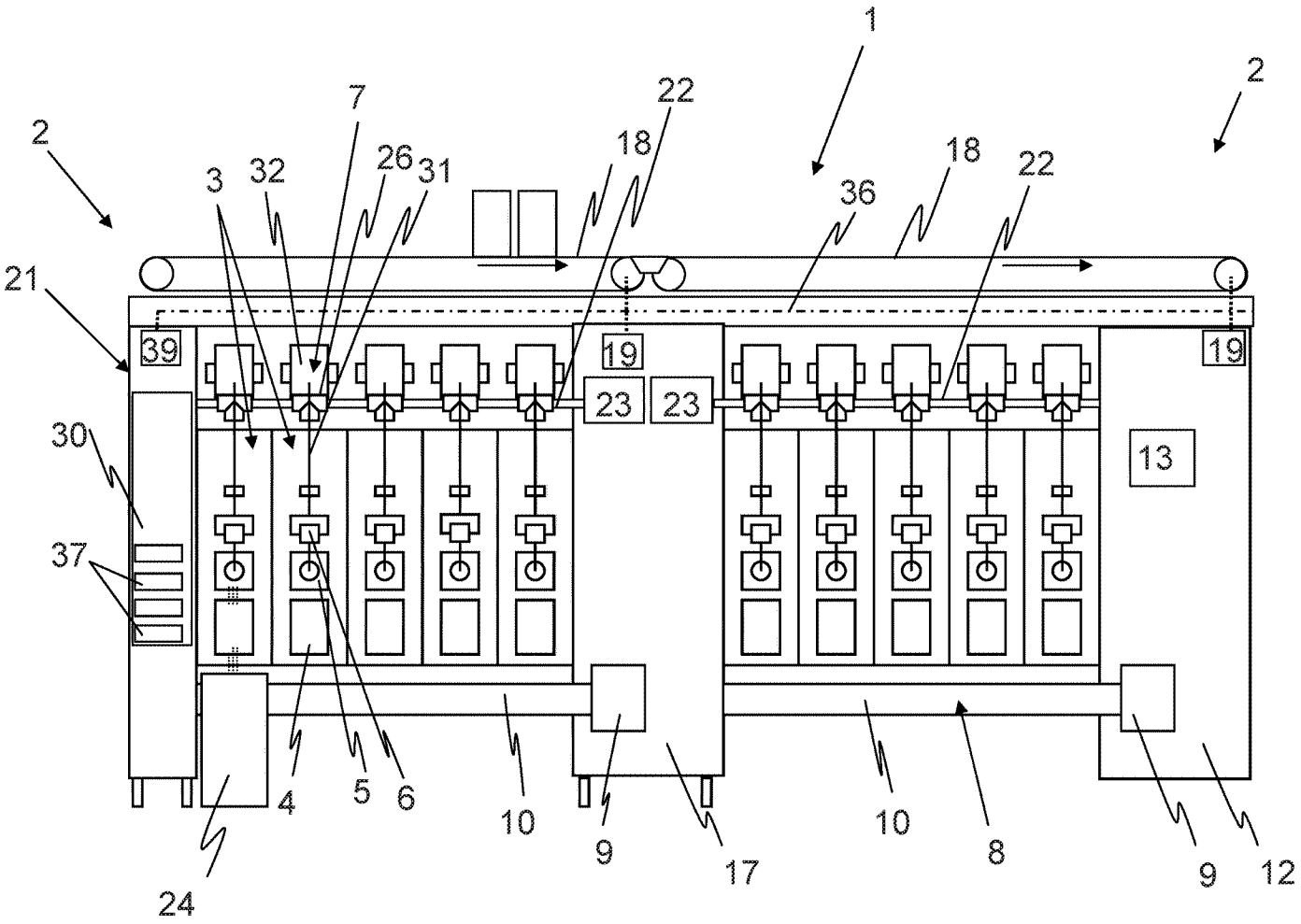
FIG. 5 is a spinning machine in a schematic top view in accordance with an additional design.

FIG. 5 shows an additional design of a spinning machine 1 as a rotor spinning machine or as an air spinning machine, whereas only the differences with FIGS. 1-4 are described here. The spinning machine 1 shown in the present case features a first frame 12 on one of the front-side ends 2 of the spinning machine 1 and additionally an intermediate frame 17 arranged between the ends 2. In each case, a negative pressure source 9 is arranged in the frames 12 and 17, each of which in turn acts on one of the separate negative pressure channels 10. Each of the draw-off devices 6 is driven by means of an individual drive 11, while central drives 23 are preferably provided for the additional work elements 4, 5, 7, 28, 29.

The design offers the advantage that all the central drives 23 and the belt drives 19, 39 can be accommodated in a distributed manner both in the intermediate frame 17 and in the front-side frame 12. Particularly in the case of a drive arranged in a group-by-group manner, with which at least two drives are provided for each longitudinal side of the spinning machine 1, this is advantageous. It is nevertheless possible to, as described with reference to FIG. 4, arrange the supply device 21 in a space-saving manner at the other front-side end 2 of the spinning machine 1. Of course, the supply device 21 could, however, also be provided in the area of the front-side frame 12.

In any case, a particularly energy-saving operation of the spinning machine 1 is also possible through the subdivided supply of negative pressure in combination with individually driven draw-off devices 6.

Figure 6:
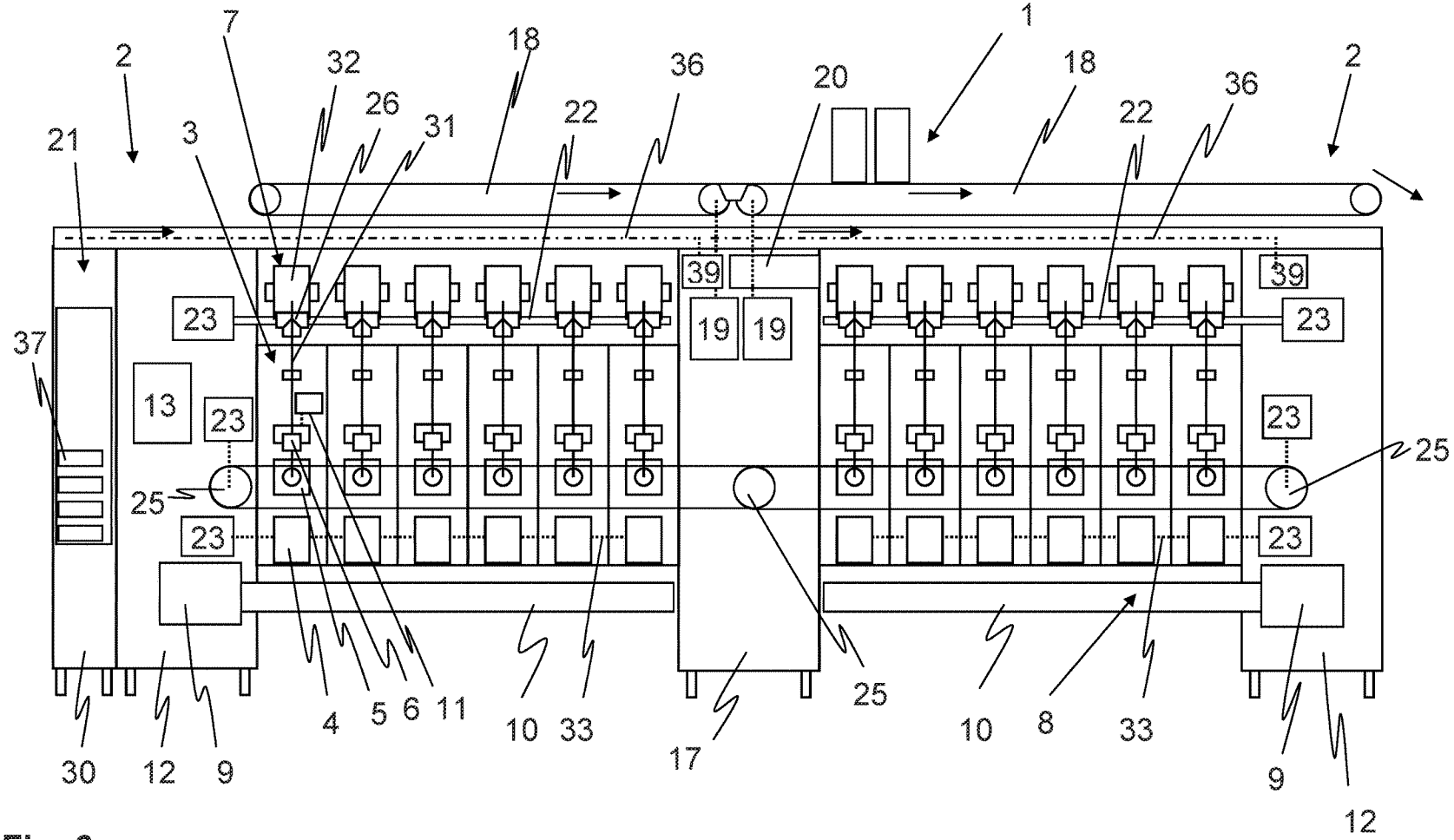
FIG. 6 is a schematic view of a spinning machine with a central supply device for empty sleeves and an intermediate frame.

FIG. 6 shows an additional design of a spinning machine 1 with an intermediate frame 17. This can be advantageous if the spinning machine 1 has a very large number of work stations 3; in the case of a rotor spinning machine, for example, more than 600 work stations 3. The spinning machine 1 largely corresponds to that already described with reference to FIG. 1, such that only the differences with the design of FIG. 1 will be discussed in the following. In the simplest case, the intermediate frame 17 can only be provided for accommodating deflection rollers 25, which are required in the case of operating elements 29, 35 driven centrally by means of tangential belts 27. In the present case, however, the drives 19 of the package conveyor belts 18 are also arranged in the intermediate frame 17. This makes it possible to accommodate additional devices at the ends 2 or in the frames 12, instead of the drives 19 of the package conveyor belts 18. In deviation from FIG. 1, in the present case, central drives 23 are provided for the feed devices 4 and for the spinning chambers 5 or spinning rotors 35, as the case may be. These as well are to be understood as merely exemplary. Depending on the type of the spinning machine 1, other or additional work elements can also be driven centrally, or individual drives 11 can also be provided for some work elements.

In the present case, an intermediate storage unit 20 is also provided in the intermediate frame 17; in this, a certain number of empty sleeves 37 can be stored. Thus, it is possible to supply the work stations 3, which are located farther away from the central sleeve storage unit 30, from the intermediate storage unit 20, and the work stations located near the central sleeve storage unit 30 from the central sleeve storage unit 30. Herein, the empty sleeves 37 can be delivered to the individual work stations of at least one longitudinal side of the machine 1 by means of a single sleeve conveyor belt 36 from both the central sleeve storage unit 30 and the intermediate storage unit 20. In the present case, however, two sleeve conveyor belts 36 are provided, whereas the intermediate storage unit 20 can be fed with empty sleeves 37 from the central sleeve storage unit 30. Thereby, the productivity of the spinning machine 1 can be further increased, since the wait times for empty sleeves 37 can be considerably reduced.

In deviation from the view that is shown, it is also possible to provide one or two additional negative pressure sources 9 in the intermediate frame 17; these are each connected to an additional, separate negative pressure channel 10. For example, an intermediate frame 17, placed essentially in the middle between the front-side ends 2, can be provided with two negative pressure sources 9, which in each case supply the work stations 3 in the areas adjacent to the intermediate frame on the left and right. However, the work stations 3 in the areas close to the front-side ends 2 are supplied by the negative pressure sources 9 provided there. With a design of this type, particularly long spinning machines 1 can be realized, whereas the losses of negative pressure can nevertheless be kept low. However, an asymmetrical structure of the spinning machine 1 can also be provided, with which the intermediate frame 17 is arranged between the two front-side ends 2, but is arranged externally. In this case, it is preferable that only a negative pressure source 9 is arranged in the intermediate frame 17, which, together with a negative pressure source 9 arranged in one of the front-side frames 12, supplies the work stations 3 of the longer machine section.

The invention is not limited to the illustrated embodiments.

Thus, in deviation from the view shown in FIGS. 1 and 4, it is not absolutely necessary to divide the work stations 3 of a longitudinal side of the spinning machine 1 into equally sized groups. It is also conceivable to provide a larger and a smaller group, or even more than two groups on each longitudinal side of the spinning machine 1. Thus, each of the groups forms its own production group, which is assigned with its own central drives 23 and its own negative pressure source 9, such that, in each of the production groups, a different product can also be produced independently of the others. In any case, however, through the division into at least two production groups by the respectively separate negative pressure source 9, it is ensured that a sufficient negative pressure is achieved in each of the negative pressure channels 10 during operation. Herein, the supply of negative pressure arranged in a group-by-group manner also offers the option of adjusting the level of negative pressure in the negative pressure channels 10 in a varying manner in accordance with the intended product or in accordance with the application provided in the respective production groups.

Furthermore, at each of the two ends 2 of the spinning machine 1, a central supply device 21 for empty sleeves 37 could also be provided with at least one central sleeve storage unit 30, which improves flexibility in the case of multi-party application, and further reduces wait times for empty sleeves 37.

Additional variations and combinations within the framework of the claims also fall under the invention.

LIST OF REFERENCE SIGNS

1 Spinning machine
2 Front-side end of the spinning machine
3 Work station
4 Feed device
5 Spinning chamber
6 Draw-off device
7 Winding device
8 Suction device
9 Negative pressure source
10 Negative pressure channel
11 Individual drive
12 Frame
13 Central control device
14 Suction point
15 Drafting device
16 Pair of delivery rollers
17 Intermediate frame
18 Package conveyor belt
19 Drive of the package conveyor belt
20 Intermediate storage unit for empty sleeves
21 Central supply device for empty sleeves
22 Winding roller shaft
23 Central drive
24 Storage hopper
25 Deflection rollers
26 Winding roller
27 Tangential belt
28 Thread guide rod
29 Opening roller
30 Central storage unit for empty sleeves
31 Yarn
32 Coil
33 Shaft
34 Division of negative pressure channels
35 Spinning rotor
36 Sleeve conveyor belt
37 Empty sleeves
38 Spinning nozzle
39 Drive of the sleeve conveyor belt

The invention claimed is:

1. A spinning machine, comprising:

a plurality of work stations arranged side by side between two front-side ends along at least one longitudinal side of the spinning machine;

each work station comprising a draw-off device and an individual drive for the draw-off device;

each work station further comprising additional driven work elements for production and winding of a yarn, the additional work elements comprising at least a feed device, a spinning chamber comprising a spinning rotor or a spinning nozzle, and a winding device; and a suction device that generates negative pressure at the work stations, the suction device comprising at least one negative pressure source and at least two negative pressure channels, each of the negative pressure channels extending in a longitudinal direction of the spinning machine only over one part of the work stations.

2. The spinning machine according to claim 1, wherein the suction device comprises two of the negative pressure sources, each of the negative pressure sources connected to a separate negative pressure channel.

3. The spinning machine according to claim 2, wherein one of the negative pressure sources is arranged on one of the two front-side ends of the spinning machine.

4. The spinning machine according to claim 2, wherein one of the negative pressure sources is arranged in a middle area between the two front-side ends of the spinning machine.

5. A spinning machine, comprising:

a plurality of work stations arranged side by side between two front-side ends along at least one longitudinal side of the spinning machine;

each work station comprising a draw-off device and an individual drive for the draw-off device;

each work station further comprising additional driven work elements for production and winding of a yarn, the additional work elements comprising at least a feed device, a spinning chamber, and a winding device;

a suction device that generates negative pressure at the work stations, the suction device comprising at least one negative pressure source and at least two negative pressure channels, each of the negative pressure channels extending in a longitudinal direction of the spinning machine only over one art of the work stations;

wherein the suction device comprises two of the negative pressure sources, each of the negative pressure sources connected to a separate negative pressure channel; and wherein one of the negative pressure sources is arranged on each of the two front-side ends of the spinning machine.

6. The spinning machine according to claim 1, wherein each work station comprises at least one suction point configured with the spinning chamber or the feed device.

7. The spinning machine according to claim 6, wherein the spinning machine is an air jet spinning machine, each work stations comprising a first suction point configured with the spinning chamber and a second suction point configured with the feed device.

8. The spinning machine according to claim 1, wherein the negative pressure source comprises a fan and a drive for the fan that is controlled by a central control device of the spinning machine.

9. The spinning machine according to claim 1, wherein at least 20% of the work stations along the longitudinal side of the spinning machine are connected to each of the negative pressure channels.

10. The spinning machine according to claim 1, wherein the negative pressure channels are arranged in an aligned manner one behind the other in the longitudinal direction of the spinning machine.

11. The spinning machine according to claim 1, wherein the spinning machine is an air jet spinning machine and a negative pressure of at least 2000 Pa is achieved in each of the two negative pressure channels at an end of the respective negative pressure channel opposite to the negative pressure source.

12. The spinning machine according to claim 1, wherein each work station comprises an individual drive for the feed device.

13. The spinning machine according to claim 1, wherein the feed device further comprises a drafting device, each work station comprising an individual drive for the drafting device.

14. The spinning machine according to claim 1, wherein the work stations are arranged side by side between the front-side ends along each longitudinal side of the spinning machine.

15. The spinning machine according to claim 1, wherein each of the additional work elements of the work stations is driven by an individual drive.

16. The spinning machine according to claim 1, wherein the additional work elements of the work stations are driven by one or more central drives.

17. The spinning machine according to claim 16, wherein the additional work elements are divided into at least two groups of identical ones of the work elements along the longitudinal side of the spinning machine, each of the groups driven by a common central drive, the common central drives arranged in a frame at one the front-side ends.

18. The spinning machine according to claim 1, further comprising at least two package conveyor belts arranged one behind the other in the longitudinal direction of the spinning machine.

19. The spinning machine according to claim 1, further comprising an intermediate storage unit for empty sleeves.

20. The spinning machine according to claim 1, wherein the suction device comprises two of the negative pressure sources, each of the negative pressure sources connected to a separate negative pressure channel and at least one of the negative pressure sources arranged in an intermediate frame in a middle area between the two front-side ends of the spinning machine, and wherein any combination of central drives for the additional work elements, deflection rollers of the central drives, or storage units for empty sleeves are also arranged in the intermediate frame.

21. The spinning machine according to claim 1, further comprising a central storage unit for empty sleeves arranged in a frame at each of the front-side ends.

22. The spinning machine according to claim 1, further comprising an electrical energy connection and a compressed air supply connection at any one or combination of one of the front-side ends, both of the front-side ends, or at a middle area between the two front-side ends.

* * * * *